US005097668A

United States Patent [19]

Albers et al.

[11] Patent Number: 5,097,668

[45] Date of Patent: Mar. 24, 1992

[54] ENERGY REUSE REGENERATOR FOR LIQUID DESICCANT AIR CONDITIONERS

[75] Inventors: Walter F. Albers, 2626 E. Arizona Biltmore Cir. #26, Phoenix, Ariz. 85016; James R. Beckman, Phoenix, Ariz.

[73] Assignee: Walter F. Albers, Phoenix, Ariz.

[21] Appl. No.: 605,950

[22] Filed: Oct. 30, 1990

[51] Int. Cl.[5] ..... F25D 17/08

[52] U.S. Cl. ..... 62/94; 62/271

[58] Field of Search ..... 62/271, 94

[56] References Cited

U.S. PATENT DOCUMENTS

| | | | |
|---|---|---|---|
| 2,273,108 | 2/1942 | Hibberd | 62/94 |
| 2,284,914 | 6/1942 | Miller | 62/271 X |
| 2,557,204 | 6/1951 | Richardson | 62/271 X |
| 4,222,244 | 9/1980 | Meckler | 62/271 X |
| 4,803,846 | 2/1989 | Assaf | 62/271 X |
| 4,841,740 | 6/1989 | Assaf | 62/271 |
| 4,939,906 | 7/1990 | Spatz et al. | 62/271 X |
| 4,955,205 | 9/1990 | Wilkinson | 62/94 |

*Primary Examiner*—William E. Tapolcai
*Attorney, Agent, or Firm*—William W. Holloway; Charles E. Cates

[57] ABSTRACT

A method and apparatus for regenerating aqueous desiccants used in liquid desiccant air conditioners is disclosed. The method and apparatus utilizes a desiccant boiler and a desiccant evaporator/steam condenser in combination with heat exchangers. The evaporator/-condenser receives steam produced by the boiler to provide a reuse of heat for regeneration. The boiler and the evaporator/condenser each can provide substantially complete regeneration of a portion of the liquid desiccant.

5 Claims, 1 Drawing Sheet

ENERGY REUSE REGENERATOR FOR LIQUID DESICCANT AIR CONDITIONERS

BACKGROUND OF THE INVENTION

1. Field of the Invention

This invention relates generally to improved regeneration of liquid desiccants of the type found in air conditioners which utilize liquid desiccants for dehumidifying air.

2. Description of the Related Art

The use of hydroscopic liquids, such as lithium chloride (LiCl), lithium bromide (LiBr) or calcium chloride ($CaCl_2$) solutions, to dehumidify air are well known. However, use of these devices has been limited owing to problems associated with regenerating (i.e., removing water from) the liquid desiccant. Regeneration generally requires contacting the liquid desiccant with hot gas which absorbs the excess moisture or heating the liquid desiccant to drive off excess moisture. The heated air regenerators are costly to operate especially where waste heat is not available. Utilization of boiler-type regenerators is found to be expensive, requiring specialty corrosion-resistant metals. If pressurized boilers are employed to provide higher efficiency operation, costly components are needed and safety issues become more complex.

U.S. Pat. No. 4,939,906, entitled Multi-Stage Boiler/Regenerator For Liquid Desiccant Dehumidifiers, issued on July 10, 1990, and invented by Mark W. Spatz and John J. Tandler, describe a liquid desiccant rejuvenation system which uses both a desiccant boiler and an evaporator/condenser. The evaporator/condenser unit, coupled in series with the desiccant boiler serves as a preconditioning unit for the desiccant boiler unit. Some energy reuse is disclosed, however, all of the desiccant to be regenerated must be introduced into the desiccant boiler unit.

A need has therefore been felt for apparatus and an associated method which can provide regeneration of hydroscopic liquids while reducing the liquid heat exchange needs for the process and reducing the requirements for specialized materials in fabricating the apparatus.

FEATURES OF THE INVENTION

It is an object of the present invention to provide an improved method and apparatus for regeneration of liquid desiccants.

It is a feature of the present invention to provide an improved method and apparatus for the regeneration of liquid desiccants reduces the requirements for heat exchange units.

It is yet another feature of the present invention to provide a method and apparatus for the regeneration of liquid desiccants which reduces the requirements for non-corrosive materials.

SUMMARY OF THE INVENTION

The present invention overcomes the above mentioned problems by providing a novel desiccant boiler and a combined desiccant evaporator/steam condenser to produce an effective and economic liquid desiccant regeneration system for air conditioners. The term "air conditioner" as used herein refers to a liquid desiccant using apparatus which dehumidifies air and may also provide cooling.

Regeneration of the liquid desiccant from an air conditioner is accomplished by heating the liquid desiccant in a first liquid-to-liquid heat exchanger, and a portion of the liquid desiccant in an evaporator/condenser, and another portion of the liquid desiccant in a second liquid-to-liquid heat exchanger and in a boiler. This heat is provided from concentrated liquid desiccant flowing back to the air conditioner, from condensing steam in the evaporator/condenser provided from the boiler, and from energy furnished to the boiler by, for example, combustion products of a natural gas-fueled burner or electrical heaters. The regeneratable liquid desiccant from the air conditioner flows through the first liquid-to-liquid heat exchanger with part of this liquid desiccant flow directed to the evaporator/condenser which provides for complete regeneration of the liquid desiccant while a second but diminished second liquid desiccant flow passes through a second liquid-to-liquid heat exchanger and is regenerated within the boiler. The regenerated desiccant liquid is cooled as it returns to the air conditioner through the first and second liquid-to-liquid heat exchangers.

As complete regeneration of the desiccant liquid occurs both in the boiler and in the evaporator/condenser using steam from the boiler, energy is reused. In a preferred embodiment, the steam condensate is collected from the evaporator/condenser and then flowed through the first liquid-to-liquid heat exchanger wherein it is cooled and the sensible energy transferred to the heating liquid desiccant flow.

These and other features of the present invention will be understood upon reading of the following description along with the drawing.

DESCRIPTION OF THE PREFERRED EMBODIMENT

1. Detailed Description of the FIGURE

Figure 1:
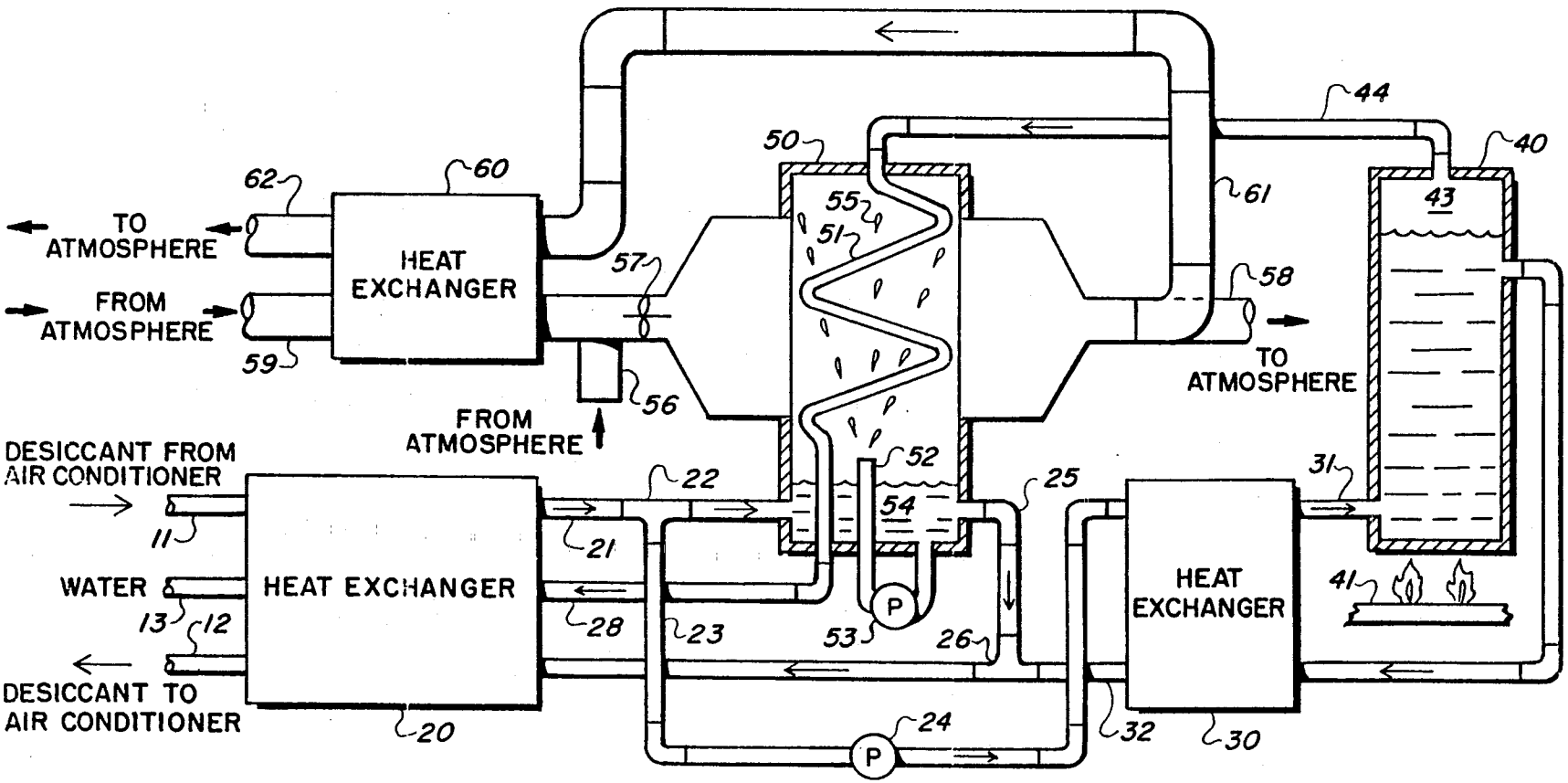
FIG. 1 is a schematic view of a liquid desiccant regeneration system according to the present invention.

Referring to FIG. 1, the regenerator will be described with reference to its operation. Major elements are a first heat exchanger 20, a second heat exchanger 30, a boiler 40, and an evaporator/condenser 50. Liquid desiccant from an air conditioner is brought via pipe 11 to heat exchanger 20 which may be any suitable form of liquid-to-liquid heat exchanger, wherein the liquid desiccant is increased in temperature from 32° C. to 82° C., for example. The liquid desiccant moves by pipe 21 to tee 22 where more than half of the liquid desiccant is caused to flow via pipe 23 by control pump 24 to heat exchanger 30, which may be any suitable liquid-to-liquid heat exchanger. While in heat exchanger 30, the liquid desiccant increases in temperature to over 138° C., for example, and is routed by pipe 31 to boiler 40. The desiccant may be controlled to boil at a set temperature of 149° C. for example when utilizing lithium bromide, with energy furnished by heater 41. Energy supply to heater 41 may be combustion products of a natural gas or wood for instance, or the energy supply may be from resistance or radiant electric heaters. The liquid desiccant leaving boiler by pipe 42 and at the approximate temperature of the boiling liquid enters heat exchanger 30 where it exchanges sensible energy with the liquid desiccant moving to boiler 40 and may exit into pipe 32 at 88° C., for example. The liquid desiccant then passes through heat exchanger 20 losing heat to the liquid desiccant stream arriving from the air conditioner and exits heat exchanger 20 at 35° C. for instance returning to an air conditioner via pipe 12.

After passing through a liquid/vapor separator zone 43 of boiler 40, steam moves through pipe 44 to evaporator/condenser 50 where the steam enters condenser 51. In a preferred embodiment, condenser 51 is a spiral tube although other types of condensers may be utilized. The heated liquid desiccant arriving to evaporator/condenser 50 via pipe 21 may be sprayed on condenser 51 causing heat transfer utilizing a spray means consisting of a spray nozzle 52 connected to pump 53 which draws liquid from basin 54. Evaporation of water from the liquid desiccant is affected by increasing the temperature of an air stream passing approximate to condenser 51 and further contacting liquid desiccant droplets 55 developed through spray nozzle 52. For example, heating of an ambient air stream of 35° C. 40% relative humidity to 88° C. will lower its relative humidity to 3%. In simplest operation, ambient air enters duct 56 by air movement caused by fan 57 and following its rise in temperature and gain in absolute humidity in the evaporator/condenser 50 the air exits to the atmosphere via duct 58. In a more complex and energy saving configuration, air supplied to evaporator/condenser 50 is preheated by first entering duct 59 to heat exchanger 60, which may be any suitable air-to-air heat exchanger. Heated air exiting evaporator/condenser 50 is routed to heat exchanger 60 by means of duct 61 therein exchanging its heat with incoming ambient air before discharging via duct 62. The regenerated liquid desiccant exits evaporator/condenser 50 via pipe 25 which joins the desiccant stream in pipe 32 by means of tee 26 and flows through heat exchanger 30 surrendering its heat. Condensate from condenser 51 may be drawn off as hot water by means of pipe 27 or may be routed to heat exchanger 20 via pipe 28 giving its heat to the liquid desiccant stream from the air conditioner that entered heat exchanger 20 by means of pipe 11. The cooled water exits heat exchanger 20 through pipe 13 and may be returned to an air conditioner of air humidification or may be used for any other suitable purpose.

2. Description of the Preferred Embodiment

The present invention provides that a evaporator/-condenser and a desiccant boiler operate in parallel to regenerate the liquid desiccant. The heat from the desiccant boiler is reused in the evaporator/condenser unit and the heat from both the desiccant boiler and the evaporator/condenser unit are reused to heat the incoming diluted desiccant. The parallel operation of the desiccant boiler and the evaporator and condenser is important because the size of the liquid heat exchange units can be reduced. The evaporator/condenser unit, operating at a relatively high temperature, permits the air, heated as a result of the liquid desiccant regeneration, to be reused to heat the incoming air.

The foregoing description is included to illustrate the operation of the preferred embodiment and is not meant to limit the scope of the invention. The scope of the invention is to be limited only by the following claims. From the foregoing description, many variations will be apparent to those skilled in the art that would yet be encompassed by the spirit and scope of the present invention.

What is claimed is:

1. A process for regenerating a liquid desiccant, said process comprising the steps of:

regenerating a diluted liquid desiccant first portion in an evaporator/condenser unit to form a regenerated liquid desiccant first portion;

regenerating a diluted liquid desiccant second portion in a desiccant boiler unit to form a regenerated liquid desiccant second portion, said desiccant boiler unit vaporizing moisture in said diluted liquid desiccant second portion;

transferring said vaporized moisture to a condenser portion of said evaporator/condenser unit to provide heat thereto;

distributing said diluted liquid desiccant first portion into a chamber of said evaporator/condenser unit;

heating said chamber with said condenser portion;

passing a gas through said chamber;

transferring sensible heat from said regenerated liquid desiccant second portion from said desiccant boiler to said diluted liquid desiccant in a second heat exchange unit;

transferring sensible heat from said regenerated liquid desiccant second portion from said second heat exchange unit and said regenerated liquid desiccant first portion to said diluted liquid desiccant first and second portions in a first heat exchange unit;

transferring sensible heat for a vapor/condensate material from said condenser portion to said dilute liquid desiccant first and second portions, and transferring heat from said chamber with said gas prior to passing said gas through said chamber.

2. The process of claim 1 further comprising the steps of:

applying diluted liquid desiccant to said first heat exchange unit from an air conditioner to form said diluted liquid desiccant first and second portions; and applying said regenerated liquid desiccant from said first heat exchange unit to said air conditioner.

3. Apparatus for regenerating a liquid desiccant from an air conditioning system, said apparatus comprising:

a first heat exchange unit having a diluted liquid desiccant and a regenerated liquid desiccant transmitted therethrough, said first heat exchanger unit adapted to transfer sensible heat from said regenerated liquid desiccant to said diluted liquid desiccant;

an evaporator/generator unit regenerating a firs portion of said diluted liquid desiccant form said first heat exchange unit to form a regenerated liquid desiccant first portion, said regenerated liquid desiccant first portion being applied to said first heat exchange unit;

a second heat exchange unit having a second portion of said diluted liquid desiccant and a second portion of a regenerated liquid desiccant transmitted therethrough, said second heat exchange unit adapted to transfer sensible heat from said regenerated liquid desiccant second portion to said diluted liquid desiccant second portion; and a desiccant boiler regenerating said diluted liquid desiccant second portion from said second heat exchange unit to form said second regenerated liquid desiccant portion, said desiccant boiler vaporizing moisture in said diluted liquid desiccant second portion, said vaporized moisture being transferred to said evaporation/condenser unit for transfer of heat thereto; wherein said vaporized moisture is applied to a condenser portion of said evaporator/condenser unit, and wherein a vapor/- condensate output from said condenser portion is applied to said first heat exchange unit, said first heat exchange unit adapted to transfer sensible heat from said vapor/condensate output to said diluted liquid desiccant first and second portions.

4. The apparatus of claim 3 wherein said evaporator/-condenser unit includes:

a chamber region, said condenser portion extending into said chamber;

distribution apparatus for distributing said diluted liquid desiccant first portion into said chamber; and gas apparatus for moving a gas through said chamber.

5. The apparatus of claim 3 wherein said diluted liquid desiccant first and second portions are provided by an air conditioner; and wherein said regenerated liquid desiccant first and second portions are transferred to said air conditioner.

* * * * *

UNITED STATES PATENT AND TRADEMARK OFFICE

CERTIFICATE OF CORRECTION

PATENT NO. : 5,097,668

DATED : March 24, 1992

INVENTOR(S) : Walter F. Albers et al

It is certified that error appears in the above-identified patent and that said Letters Patent is hereby corrected as shown below:

In claim 1, column 4, line 25 the word "for" has been changed to —from—

In claim 3, column 4, line 46, the word "firs" has been changed to —first—

In claim 3, column 4, line 47, the word "form" has been changed to —from—

Signed and Sealed this

Eighth Day of June, 1993

*Attest:*

*Attesting Officer*

Michael K. Kirk

MICHAEL K. KIRK

*Acting Commissioner of Patents and Trademarks*